US008905496B2

(12) United States Patent
Burgess et al.

(10) Patent No.: US 8,905,496 B2
(45) Date of Patent: Dec. 9, 2014

(54) WALL WORK STATION

(75) Inventors: Roddy Burgess, Charlotte, NC (US); Ian Cunningham, Huntersville, NC (US); Robert Grant McRorie, Huntersville, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 85 days.

(21) Appl. No.: 12/636,181

(22) Filed: Dec. 11, 2009

(65) Prior Publication Data

US 2010/0148647 A1 Jun. 17, 2010

Related U.S. Application Data

(60) Provisional application No. 61/121,689, filed on Dec. 11, 2008, provisional application No. 61/162,885, filed on Mar. 24, 2009.

(51) Int. Cl.

| | |
|---|---|
| ***A47B 67/02*** | (2006.01) |
| ***A47F 5/08*** | (2006.01) |
| ***E04G 3/00*** | (2006.01) |
| ***A47F 1/10*** | (2006.01) |
| ***A47B 37/00*** | (2006.01) |
| ***A47B 21/03*** | (2006.01) |
| ***A47B 21/00*** | (2006.01) |
| *F21V 33/00* | (2006.01) |

(52) U.S. Cl.

CPC ..... *A47B 21/00* (2013.01); *A47B 21/0314* (2013.01); *F21V 33/0052* (2013.01)

USPC ..... 312/247; 248/274.1; 248/295.11; 108/50.02

(58) Field of Classification Search

USPC ..... 312/223.3, 245–248, 208.1; 108/152, 108/50.02, 94–96, 134; 248/295.11, 248/297.11, 274.1, 235, 240

See application file for complete search history.

(56) References Cited

U.S. PATENT DOCUMENTS

| | | | | |
|---|---|---|---|---|
| 1,730,028 A | | 10/1929 | Ball | |
| 3,089,742 A | * | 5/1963 | Powell | 312/223.5 |
| 3,862,734 A | | 1/1975 | Buchin et al. | |

(Continued)

FOREIGN PATENT DOCUMENTS

| | | | | |
|---|---|---|---|---|
| DE | 3409990 A1 | | 7/1984 | |
| FR | 2783142 A1 | | 3/2000 | |
| GB | 2285911 A | | 8/1995 | |
| WO | WO 2006078961 A2 | * | 7/2006 | F16M 11/04 |

OTHER PUBLICATIONS

U.S. Appl. No. 13/016,190, Bustle et al. , Jan. 28, 2011.

*Primary Examiner* — Janet M Wilkens
*Assistant Examiner* — Andrew Roersma
(74) *Attorney, Agent, or Firm* — Dennis J. Williamson; Moore & Van Allen PLLC

(57) ABSTRACT

A work station comprises a mounting bracket adapted to be mounted to a surface. An upper arm and a lower arm are mounted to the mounting bracket for pivoting motion about a first vertical axis. A track is pivoted to the upper arm and the lower arm about a second vertical axis where the track supports a vertically displaceable carriage. The carriage may support a monitor and work platform where the work platform supports a key board tray. A lift system supports the carriage for vertical movement. Work station mounting systems are also provided for movably supporting a work platform.

13 Claims, 12 Drawing Sheets

(56) References Cited

U.S. PATENT DOCUMENTS

| | | | | |
|---|---|---|---|---|
| 3,999,733 | A | 12/1976 | Harder, Jr. et al. | |
| 4,071,216 | A * | 1/1978 | Einhorn | 248/282.1 |
| 4,516,751 | A | 5/1985 | Westbrook | |
| 4,775,313 | A * | 10/1988 | Diloia | 425/458 |
| 4,836,478 | A | 6/1989 | Sweere | |
| 4,907,773 | A | 3/1990 | Menchetti et al. | |
| 5,007,608 | A | 4/1991 | Carroll, Jr. | |
| 5,240,215 | A | 8/1993 | Moore | |
| 5,487,525 | A * | 1/1996 | Drabczyk et al. | 248/639 |
| 5,630,566 | A | 5/1997 | Case | |
| 5,632,462 | A | 5/1997 | Kallas | |
| D380,736 | S | 7/1997 | Theis et al. | |
| 5,738,316 | A | 4/1998 | Sweere et al. | |
| 5,743,503 | A | 4/1998 | Voeller et al. | |
| 5,791,623 | A | 8/1998 | Louridas | |
| 5,797,568 | A | 8/1998 | Canton Gongora et al. | |
| 5,842,672 | A | 12/1998 | Sweere et al. | |
| 5,876,008 | A | 3/1999 | Sweere et al. | |
| D412,161 | S | 7/1999 | Theis et al. | |
| 5,918,841 | A | 7/1999 | Sweere et al. | |
| 5,924,665 | A | 7/1999 | Sweere et al. | |
| D413,110 | S | 8/1999 | Sweere et al. | |
| 5,944,896 | A * | 8/1999 | Landesman et al. | 118/500 |
| 5,947,429 | A | 9/1999 | Sweere et al. | |
| 5,967,479 | A | 10/1999 | Sweere et al. | |
| 5,992,809 | A * | 11/1999 | Sweere et al. | 248/278.1 |
| 6,012,693 | A | 1/2000 | Voeller et al. | |
| 6,015,120 | A | 1/2000 | Sweere et al. | |
| 6,019,332 | A | 2/2000 | Sweere et al. | |
| D423,745 | S | 4/2000 | Theis et al. | |
| D431,736 | S | 10/2000 | O'Brien et al. | |
| 6,189,849 | B1 * | 2/2001 | Sweere et al. | 248/286.1 |
| 6,233,791 | B1 | 5/2001 | Theis | |
| D450,903 | S | 11/2001 | Wacker et al. | |
| 6,354,549 | B2 | 3/2002 | Sweere et al. | |
| D455,916 | S | 4/2002 | Fluhrer et al. | |
| 6,367,756 | B1 * | 4/2002 | Wang | 248/278.1 |
| 6,380,484 | B1 | 4/2002 | Theis et al. | |
| 6,409,134 | B1 * | 6/2002 | Oddsen, Jr. | 248/274.1 |
| 6,419,196 | B1 | 7/2002 | Sweere et al. | |
| 6,581,887 | B2 | 6/2003 | Lapidez | |
| D477,325 | S | 7/2003 | Theis et al. | |
| D477,606 | S | 7/2003 | Theis et al. | |
| 6,709,058 | B1 | 3/2004 | Diffrient | |
| 6,712,008 | B1 * | 3/2004 | Habenicht et al. | 108/96 |
| 6,752,363 | B2 * | 6/2004 | Boele | 248/183.1 |
| 6,863,252 | B2 * | 3/2005 | Bosson | 248/278.1 |
| 6,883,764 | B1 | 4/2005 | Mileos et al. | |
| 6,959,965 | B2 | 11/2005 | Diffrient | |
| 6,994,306 | B1 | 2/2006 | Sweere et al. | |
| 7,032,870 | B2 | 4/2006 | Sweere et al. | |
| 7,063,296 | B2 | 6/2006 | Williams | |
| 7,147,190 | B2 | 12/2006 | Welles et al. | |
| 7,152,488 | B2 * | 12/2006 | Hedrich et al. | 73/849 |
| D535,432 | S | 1/2007 | Diffrient | |
| D537,323 | S | 2/2007 | Saez | |
| 7,178,469 | B2 * | 2/2007 | Goza | 108/50.01 |
| 7,195,213 | B2 | 3/2007 | Weatherly | |
| 7,252,277 | B2 | 8/2007 | Sweere et al. | |
| 7,303,173 | B2 | 12/2007 | Mileos | |
| D584,908 | S | 1/2009 | Diffrient | |
| 7,472,458 | B2 | 1/2009 | Oddsen, Jr. | |
| 7,475,946 | B2 | 1/2009 | Diffrient | |
| 7,481,170 | B2 | 1/2009 | Sommerfield | |
| 7,487,940 | B2 | 2/2009 | Saez et al. | |
| 2002/0175254 | A1 * | 11/2002 | Lee | 248/289.11 |
| 2003/0001057 | A1 | 1/2003 | Sweere et al. | |
| 2003/0057340 | A1 * | 3/2003 | Mann et al. | 248/274.1 |
| 2004/0251388 | A1 * | 12/2004 | Williams | 248/274.1 |
| 2005/0062370 | A1 * | 3/2005 | Miller | 312/208.1 |
| 2005/0121577 | A1 * | 6/2005 | Oddsen et al. | 248/225.11 |
| 2007/0120512 | A1 * | 5/2007 | Albu-Schaffer et al. | 318/568.2 |
| 2007/0181762 | A1 * | 8/2007 | Dittmer | 248/274.1 |
| 2007/0259554 | A1 | 11/2007 | Lindblad et al. | |
| 2007/0295870 | A1 * | 12/2007 | Peterson et al. | 248/125.7 |
| 2008/0026892 | A1 | 1/2008 | Asamarai et al. | |
| 2008/0142660 | A1 | 6/2008 | Goldberg et al. | |
| 2008/0168930 | A1 | 7/2008 | Calero | |
| 2008/0258029 | A1 | 10/2008 | Zhang | |
| 2009/0212184 | A1 * | 8/2009 | Bourgeois et al. | 248/288.11 |

* cited by examiner

WALL WORK STATION

This application claims benefit of priority under 35 U.S.C. §119(e) to the filing date of to U.S. Provisional Application No. 61/121,689 as filed on Dec. 11, 2008, which is incorporated herein by reference in its entirety, and U.S. Provisional Application No. 61/162,885 as filed on Mar. 24, 2009, which is incorporated herein by reference in its entirety.

BACKGROUND

The invention relates to wall arms for supporting display monitors and user input devices such as keyboards on a wall or other vertical surface. Wall arms are mounted to a wall or other surface such that they can move to position the display, keyboard or the like. Known wall arms are difficult to install and service, relatively unstable and do not stow in a small area.

SUMMARY

A work station comprises a mounting bracket adapted to be mounted to a surface. An upper arm and a lower arm are mounted to the mounting bracket for pivoting motion about a first vertical axis. A track is pivoted to the upper arm and the lower arm about a second vertical axis where the track supports a vertically displaceable carriage. The carriage may support a monitor and work platform where the work platform supports a key board tray. A lift system supports the carriage for vertical movement. Work station mounting systems are also provided for movably supporting a work platform.

DETAILED DESCRIPTION OF PREFERRED EMBODIMENTS OF THE INVENTION

Figure 1:
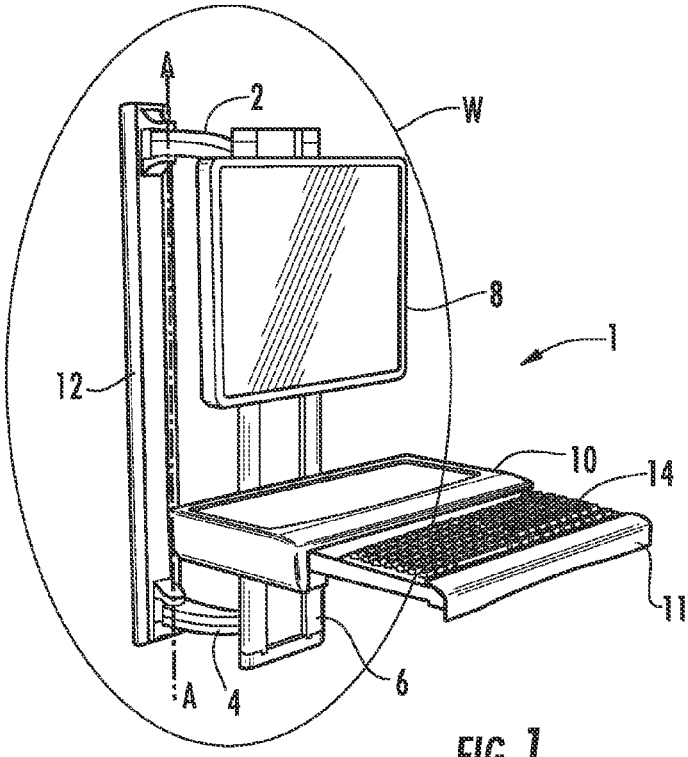
FIG. 1 is a perspective view showing an embodiment of the wall work station in a first operative position.

Referring to FIGS. 1 through 7 the wall work station of the invention is shown generally at 1 and uses a dual swing arm comprising a first upper swing arm 2 and a second lower swing arm 4 attached to a vertical track 6 that holds equipment such as a monitor 8 and work platform 10. The dual swing arm arrangement provides vertical and side-to-side motion and improves cable management, stowing, stability, ease of service/maintenance and installation. The wall work station 1 is particularly well suited for healthcare applications such as in a patient room although it may be used in a wide variety of applications. In such a healthcare environment maintaining the range of movement is important for user comfort and healthcare professional to patient interaction.

Existing products struggle with cable management because of the complexity of a single arm design where the single arm does not allow cables to run through joints without hindering the overall movement of the arm. The dual swing arm design as shown in the embodiment of FIG. 1 simplifies the mechanism, allowing cables to be run through the arm joints while allowing freedom of movement. The cables are concealed using plastic caps improving the ease of cleanability. Most existing products wall storage units stow 10"-14" from the wall. The wall work station 1 stows 6"-8" from the wall. This is an advantage in space constrained environments such as hospitals.

The work station of the invention is also more stable because the weight is distributed between the two arms 2 and 4 versus a single arm design. The dual arm structure is also easy to service because it can be lifted off of the wall without using any tools. This minimizes the amount of time that service personnel are required to be in a patient room.

The work station may be made with several different materials and processes. These processes would include extrusions, injection molding, machining or casting out of plastic, aluminum and steel.

Figure 6:
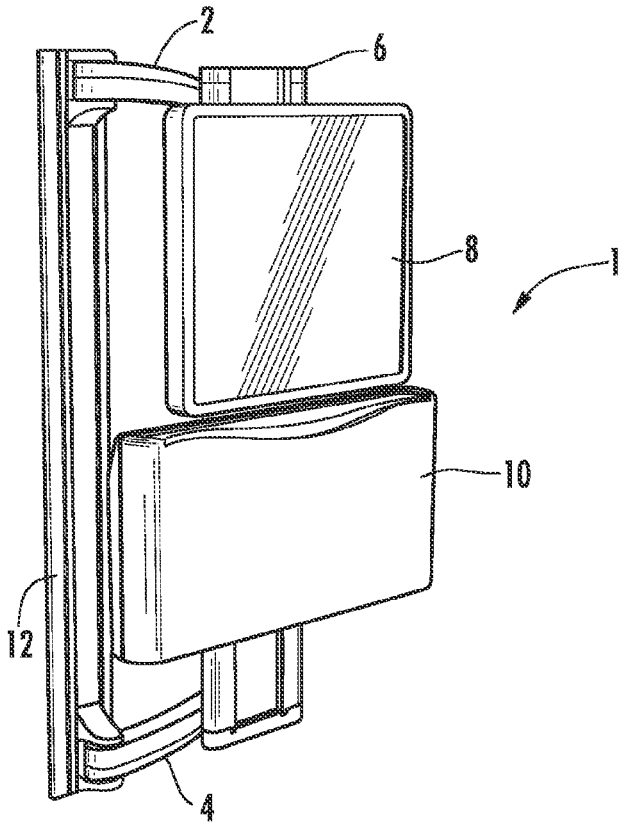
FIG. 6 is a perspective view showing the wall work station of FIG. 1 in a storage position.

Referring to the figures, in one embodiment the wall work station 1 comprises a vertically extending wall mounting bracket 12 that is mounted to a vertical support surface such as a wall W. The wall mounting bracket 12 supports an upper arm 2 and a lower arm 4 that are mounted for pivoting motion about a vertical axis A-A. The proximal ends of arms 2 and 4 are connected to a support such as a vertical track 6 that supports a work platform 10 and electrical equipment such as a monitor 8, keyboard 14, mouse, computer or the like. Support or track 6 is pivoted to the distal ends of arms 2 and 4 such that the track 6 can also pivot about axis B-B relative to the arms 2 and 4. The work platform 10 may also support a keyboard tray 11, keyboard 14 and mouse. The keyboard tray 11 and keyboard may be supported below the work platform 10 in an internal compartment. The keyboard tray 11 may slide and/or pivot into and out of the work platform such that the keyboard tray may be exposed when in use but hidden when not in use and for storage. Providing a substantially horizontal work surface 10*a* on the work platform 10 allows the work surface 10*a* to be used as a support for papers, medication and other equipment while simultaneously allowing the user to access the keyboard. The work platform 10 also rotates about a horizontal axis such that it can be rotated to a vertical position for storage as shown in FIG. 6.

Figure 3:
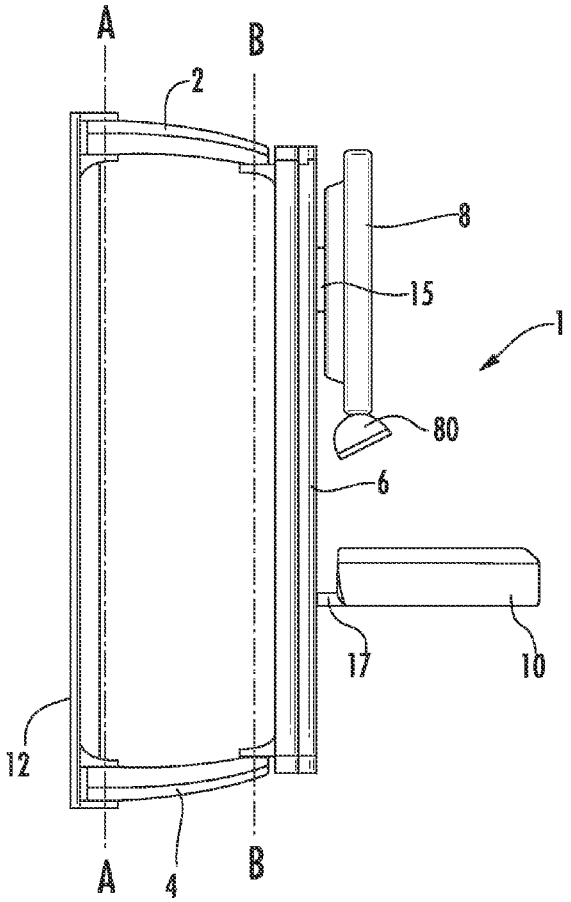
FIG. 3 is a side view showing the embodiment of the wall work station of FIG. 1.

As shown in FIG. 3, the wall arm may be provided with a light 80 for illuminating the work station 10 and keyboard. The light 80 may be mounted on the vertical support or to the monitor. The light 80 allows the system to be used in poorly lit areas such as patient rooms. The light 80 may be turned on by manually operating a switch or it may be actuated when, for example, the keyboard tray is extended.

Figure 2:
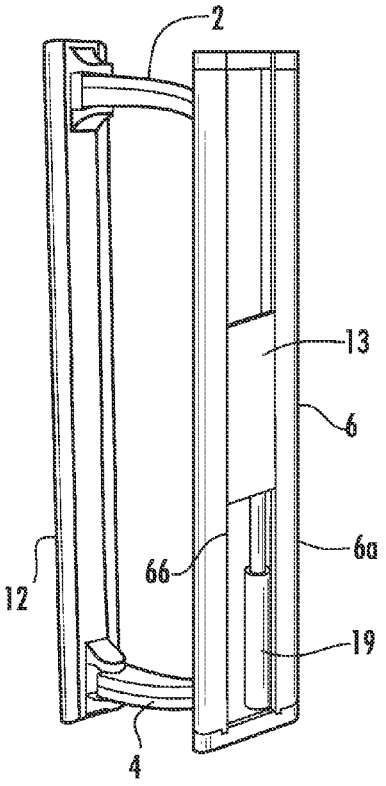
FIG. 2 is a perspective view of the wall work station of FIG. 1 with the monitor and work platform removed.

Referring to FIG. 2 the support or track 6 may support a lift device such that the monitor 8 and work platform 10 may be vertically adjustable along the track 6. In one embodiment, track 6 is formed with two vertically extending spaced apart channels 6*a* and 6*b*. A movable carriage 13 is vertically movable in the channels 6*a*, 6*b* such that it can be displaced along the length of track 6. The carriage 13 may be supported on rollers or rails in the channels 6*a*, 6*b*. The monitor support 15 and work station support 17 are connected to the carriage 13 such that the monitor 8 and work platform 10 are movabvle with carriage 13. A lift system 19 is used to assist the user in raising and lowering the carriage 13, monitor 8 and work platform 10 and to hold the carriage 13, monitor 8 and work platform 10 in the desired vertical position. The lift mechanism 19 may be comprised of springs, a counterbalanced pulley system, gas struts or the like. The carriage may have 12 to 15 inches in vertical movement to accommodate different size users. The track 6, carriage 13, monitor 8 and work platform 10 may be mounted directly to a wall without using the arms 2 and 4 or the mounting bracket 12. In such an arrangement the track 6 is fixed to the wall or other surface directly using separate fasteners where the back side of the track 6 is fixed flush with the wall.

Figure 4:
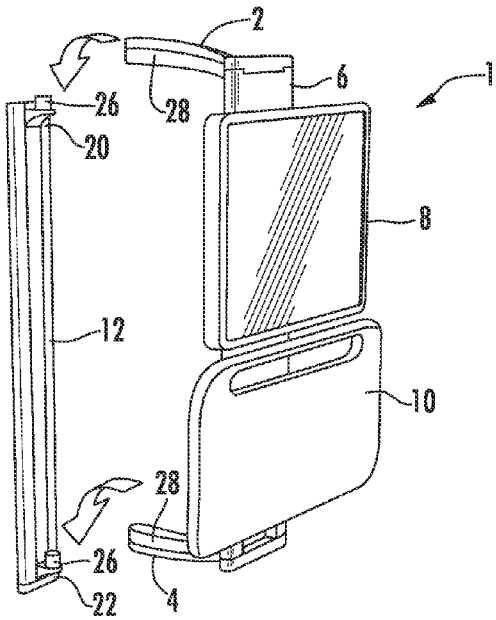
FIG. 4 is a perspective view showing the wall work station of FIG. 1 in a partially disassembled condition.

Referring to FIG. 4, the track 6 and wall arms 2 and 4 can be installed in one motion. Mounting bracket 12 includes an upper support 20 extending from the top of bracket 12 and a lower support 22 formed near the bottom of bracket 12. The supports 20 and 22 are spaced from one another the same distance as the distance between arms 2 and 4. The supports 20 and 22 each include an upwardly facing protrusion 26 that functions as a bearing surface for supporting the arms 2 and 4. The protrusions 26 are vertically aligned to form the pivots for axis A-A. The arms 2 and 4 include apertures or receptacles 28 that fit over protrusions 26 such that the arms 2 and 4 can be lifted off of or dropped onto the protrusions 26. The protrusions 26 can rotate in the receptacles 28 such that the arms 2 and 4 are freely pivotable relative to the mounting bracket 12. The installation of the arms 2 and 4 on mounting bracket 12 may be accomplished by one person. This also applies when the wall arm unit 1 requires service. The maintenance personnel can lift arms 2 and 4 off the mounting bracket 12 very quickly and easily without tools.

Figure 14:
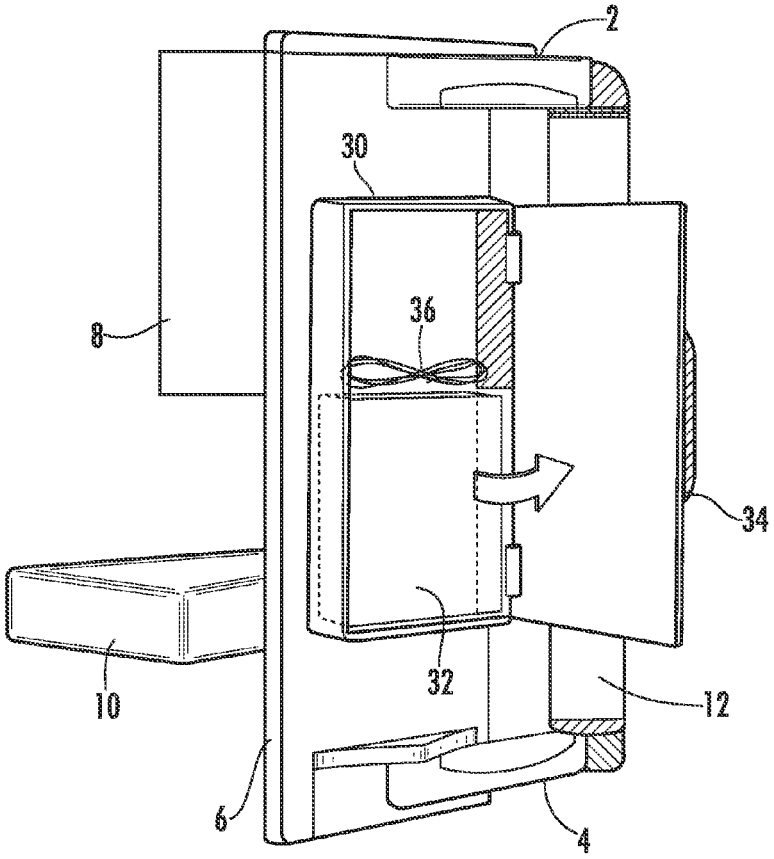
FIGS. 14 and 15 are perspective back views showing alternate embodiments of the wall work station.
Figure 15:
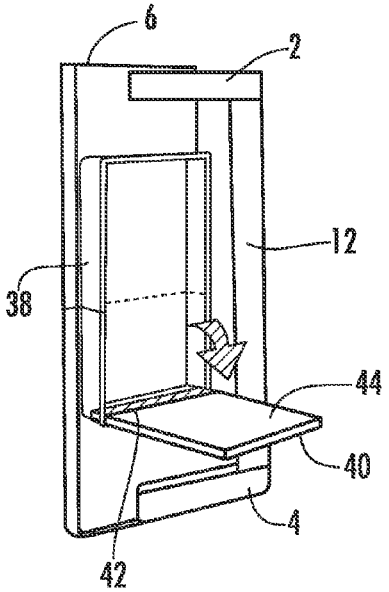

As shown in FIG. 14, a technology box 30 may be mounted to the rear of the track 6. The technology box 30 may hold a laptop computer, thin client, surge protector, power strip, docking station or other electronics 32. Connectors such as cables 36 may connect the components 32 to other components such as the keyboard and mouse, monitor or an external network. A hinged door 34 protects and isolates these components when not being serviced. Such an arrangement simplifies support and maintenance of the system for support personnel. The door 34 may also be lockable. Referring to FIG. 15, another embodiment of the tech box 38 is shown attached to the back of track 6. In this embodiment the door 40 pivots down about a horizontal hinge 42 to a horizontal position to provide a work surface 44 for holding tools, equipment and miscellaneous items when personnel are accessing the equipment stored in the tech box 38.

Figure 5:
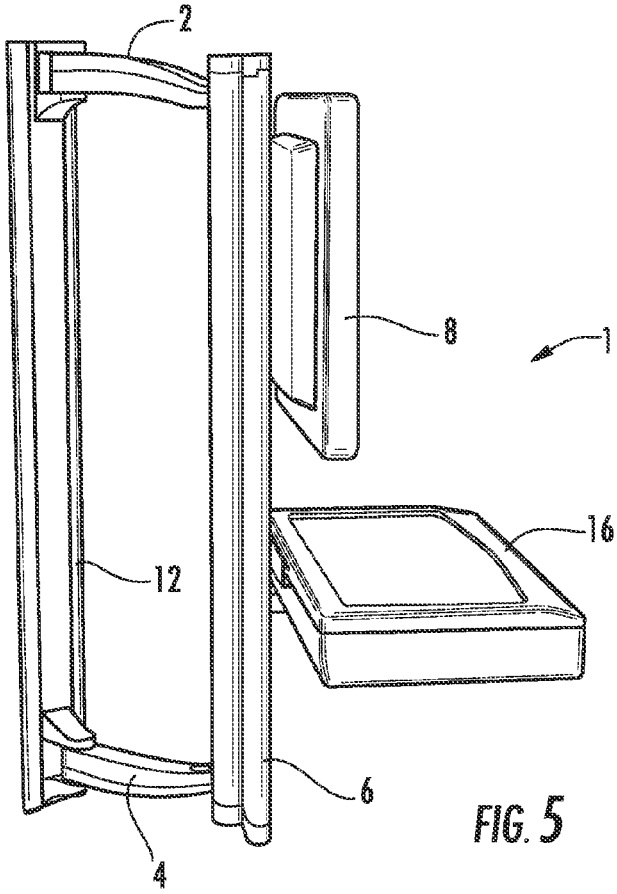
FIG. 5 is a perspective view showing the wall work station of FIG. 1 in a different operative position.
Figure 7:
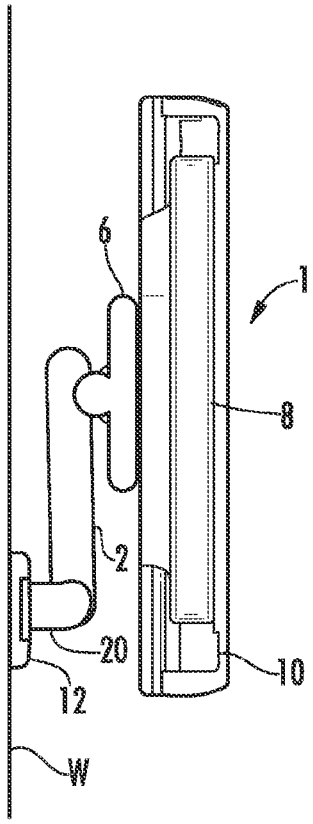
FIG. 7 is a top view showing the wall work station of FIG. 1 in a storage position.

Referring to FIGS. 1, 5, 6 and 7, movement of the wall arm support will be described. FIGS. 1 and 5 show the unit in an operative position. In this position the work platform 10 is lowered to a generally horizontal position where papers, equipment and other articles may be supported on the top surface 10*a* of work platform 10. The keyboard maybe supported on a pull-out keyboard tray 9 that may be stowed in the work station when not in use. The tray may provide +5 to −15 degrees of movement from horizontal. The arms 2 and 4 rotate 180 degrees about axis A-A relative to mounting bracket 12 such that the arms may be disposed generally parallel to the surface W to either side of pivot axis A-A. FIG. 7 shows the arms 2 and 4 rotated to one extreme position adjacent wall W. Track 6 also rotates relative to arms 2 and 4 approximately 180 degrees relative to arms 2 and 4 about axis B-B.

Figure 8A:
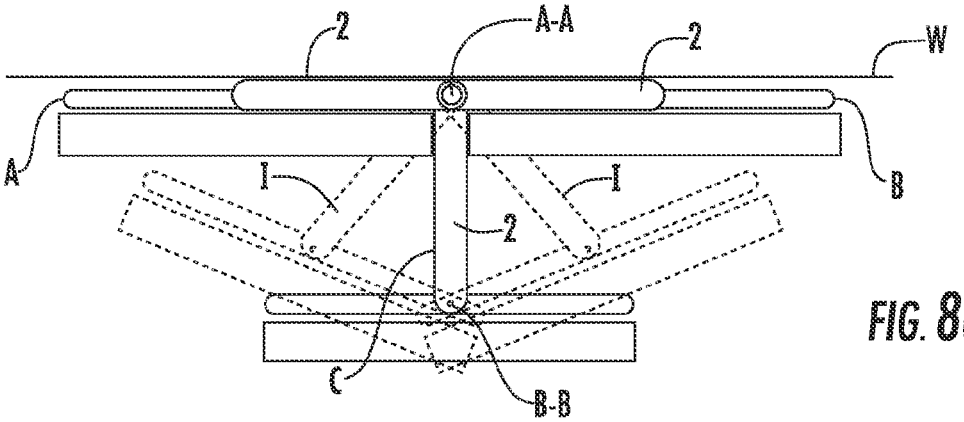
FIGS. 8*a*-8*c* are schematic top views showing the movement of the wall work station.
Figure 8B:
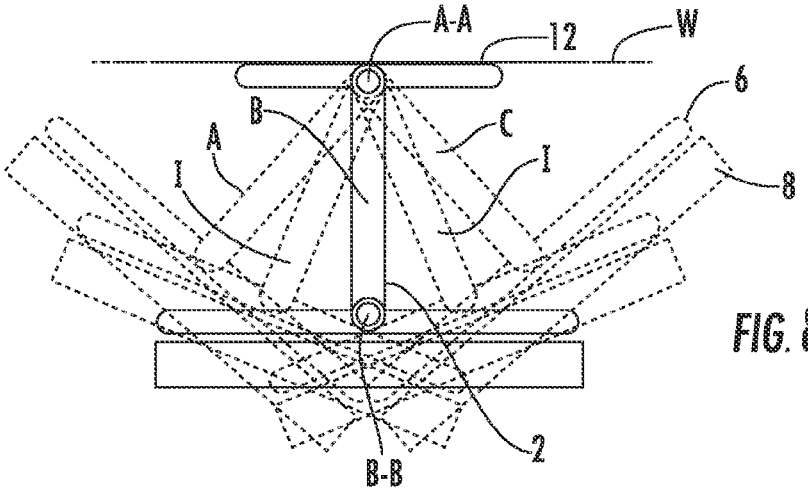
Figure 8C:
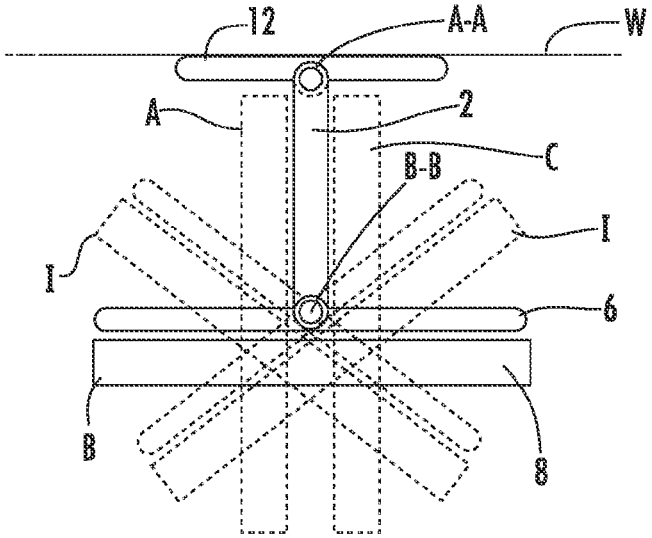

The motion of the wall arm is shown schematically in FIGS. 8*a* to 8*c*. FIG. 8*c* shows the movement of the system where the arms 2 and 4 are held stationary and the track 6 is rotated about axis B-B. Track 6 may rotate 180 degrees between a first extreme position A to a center position B and to a second extreme position C. The track 6 may also assume any intermediate position I between the extreme positions A and C.

FIG. 8*b* shows the movement of the system where the track 6 is held stationary relative to arms 2 and 4 and the arms 2 and 4 are rotated about axis A-A relative to the mounting bracket 12. The arms 2 and 4 are capable of rotating 180 degrees; however, with the track 6 in a fixed position the arms are limited to rotating as shown because the monitor 8 and work platform 10 will contact wall W. The arms 2 and 4 rotate between a first extreme position A to a center position B and to a second extreme position C. The track 6 may also assume any intermediate position I between the extreme positions A and C.

FIG. 8*a* shows the movement of the system where both the track 6 is rotated relative to the arms 2 and 4 about axis B-B and the arms 2 and 4 are rotated relative to the mounting bracket 12 about axis A-A. The arms 2 and 4 rotate between a first storage position A to a center position B and to a second storage position C. The track 6 may also assume any intermediate position I between the extreme positions A and C. In the storage positions A and B, also shown in FIGS. 6 and 7, the arms 2 and 4 are disposed parallel to and adjacent the wall W with the track 6, monitor 8 and work station 10 disposed parallel to and adjacent the wall W and arms 2 and 4.

Figure 9:
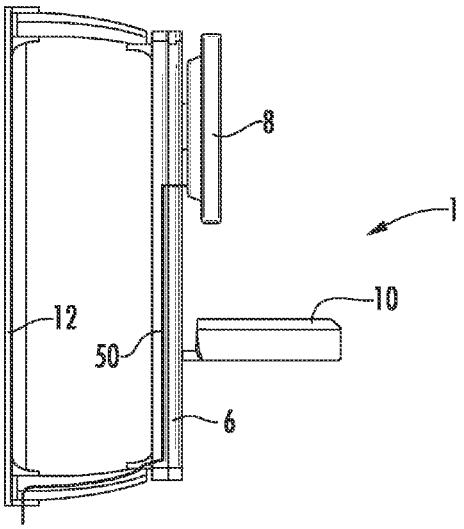
FIGS. 9 and 10 are side views of the wall work station of FIG. 1 showing the wiring paths.
Figure 10:
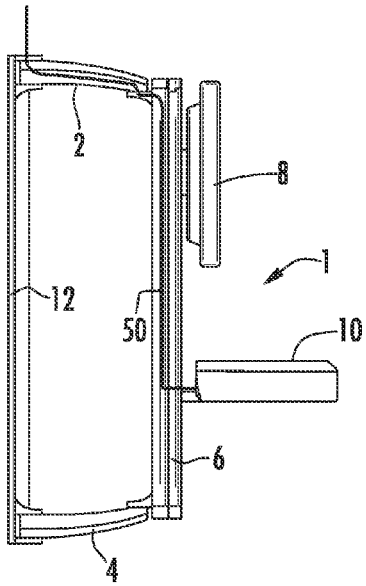

Referring to FIGS. 9 and 10 cables or wiring 50 from the monitor, keyboard, mouse or on-board computer may be passed through the track 6 and hollow arms 2 and 4 to the exterior of the wall mount. Because each of the pivots rotates only about a vertical axis, the wiring and cables 50 can pass through the pivots without becoming crimped or binding. In one embodiment the cables and wiring 50 are pre-route through the track 6 and arms 2 and 4 during manufacture of the work station such that when the unit is placed on mounting bracket 12 as shown in FIG. 4 the cabling and wiring is immediately available to the installer such that the monitor, keyboard, on-board computer and other equipment may be immediately connected without the need to run wiring through the unit.

Figure 18:
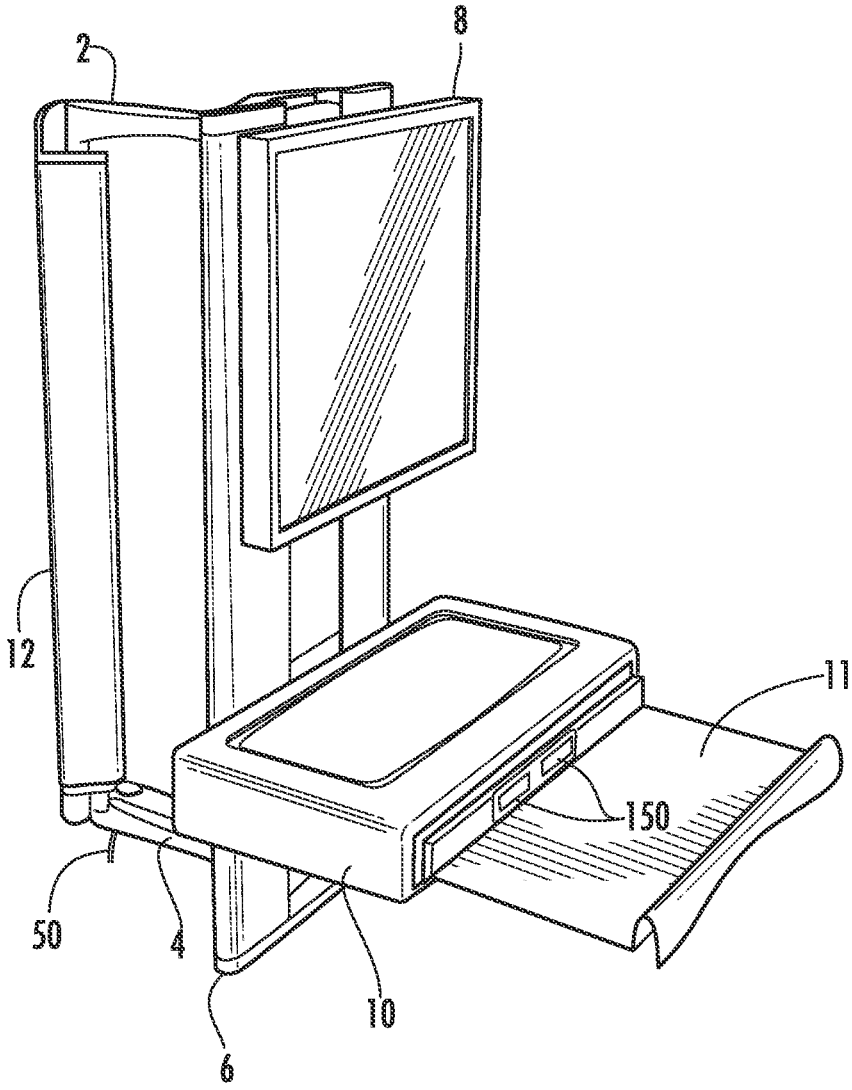
FIG. 18 is a partial perspective view showing a USB hub.

Referring to FIG. 18 an electrical connector 150 such as a USB hub may be provided to facilitate the installation and removal of the keyboard, mouse and other equipment such as a computer, lap top, thin client or other computing device used with the wall support. In one embodiment the USB hub 150 is located on tray 11 in work platform 10. The USB hub may be connected to the prewired cables and wiring 50 such that installation of this equipment is greatly facilitated. Alternatively, the pre-wiring may comprise extension cables such as USB extension cables that run from a connector on the tray 11 or support/track 6 to the technology cabinet 30 on the support. The extension cables are prewired for peripheral devices such as a keyboard and mouse and may connect to a computer in the technology cabinet 30. The USB cables run between the technology cabinet 30 on the support or track 6 and the tray 11.

Figure 11A:
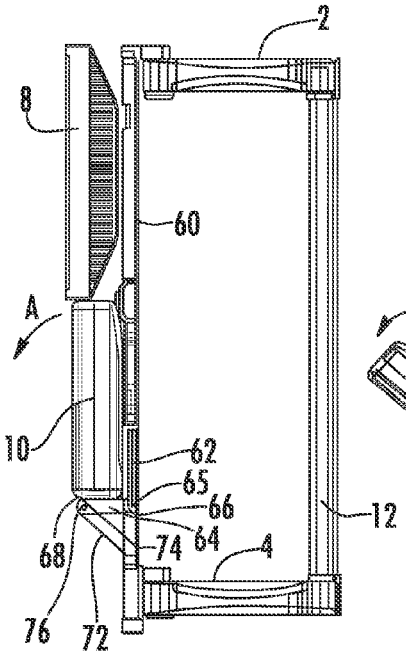
FIGS. 11*a*-11*c* are side views showing an embodiment of the structure and operation of a work station mounting system.
Figure 11B:
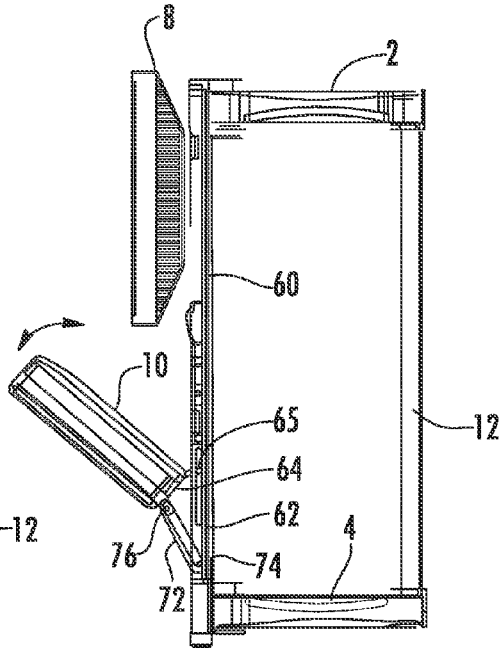
Figure 11C:
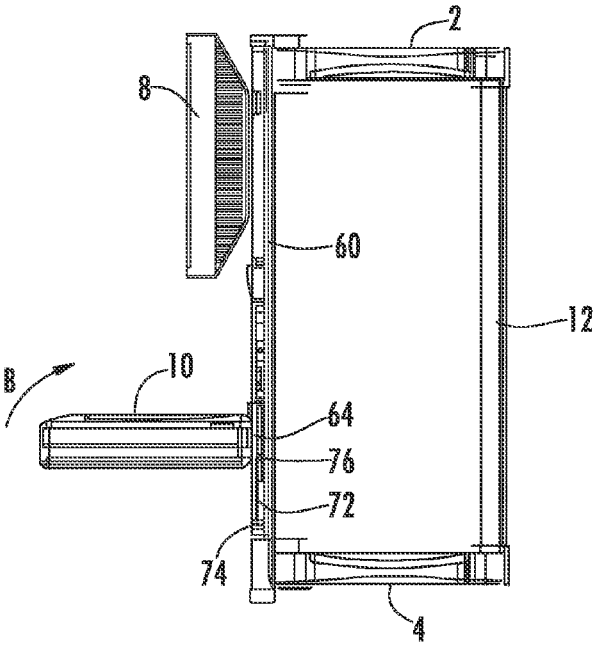

Referring to FIGS. 11*a*, 11*b* and 11*c*, a work station 10 mounting system is shown having a vertical support member 60 with a track or slot 62 formed therein. A first link 64 has a first end 66 mounted in track or slot 62 by pins 65 such that the first end 66 of the link 64 is able to move vertically in the track or slot 62 and is able to pivot about pins 65. The link 64 is connected to and supports the back side 68 of the work station 10. A second link 72 is mounted to the vertical support 60 at pins 74 such that it can pivot relative to the support but is otherwise in a fixed position relative to the support. The distal ends of the links 64 and 72 are pivoted to one another at pivot 76.

The linkage supports the work station 10 such that the top of the work station is flush with the support 60 in the storage position (FIG. 11*a*) and the back side 68 of the work station 10 is flush with the support 60 in the operational position (FIG. 11*c*). In the storage position (FIG. 11*a*) the movable end 66 of link 64 is positioned at the bottom of slot 62 and both links 64 and 72 are in an extended position. To move the work surface to the operational position, the work station 10 is pivoted in the direction of arrow A. As the work station 10 is pivoted link 64, which moves with the back side 68 of work station 10, is rotated from the extended position toward vertical support 60. Specifically, the end 66 of link 64 moves up in slot 62 as pivot 76 moves toward the vertical support 60. Link 72 is simultaneously rotated about pivot 64. The links 64 and 72 pivot until both links are disposed substantially vertically, or in an over-center position, along vertical support 60. In this position the weight of work surface maintains the work surface in the extended position. To move the work station 10 to the storage position, the work station is pivoted in the direction of arrow B until the work surface is in the position of FIG. 11*a* where the work station 10 rests on link 64. Link 64 is supported in a horizontal position by link 72.

Figure 12:
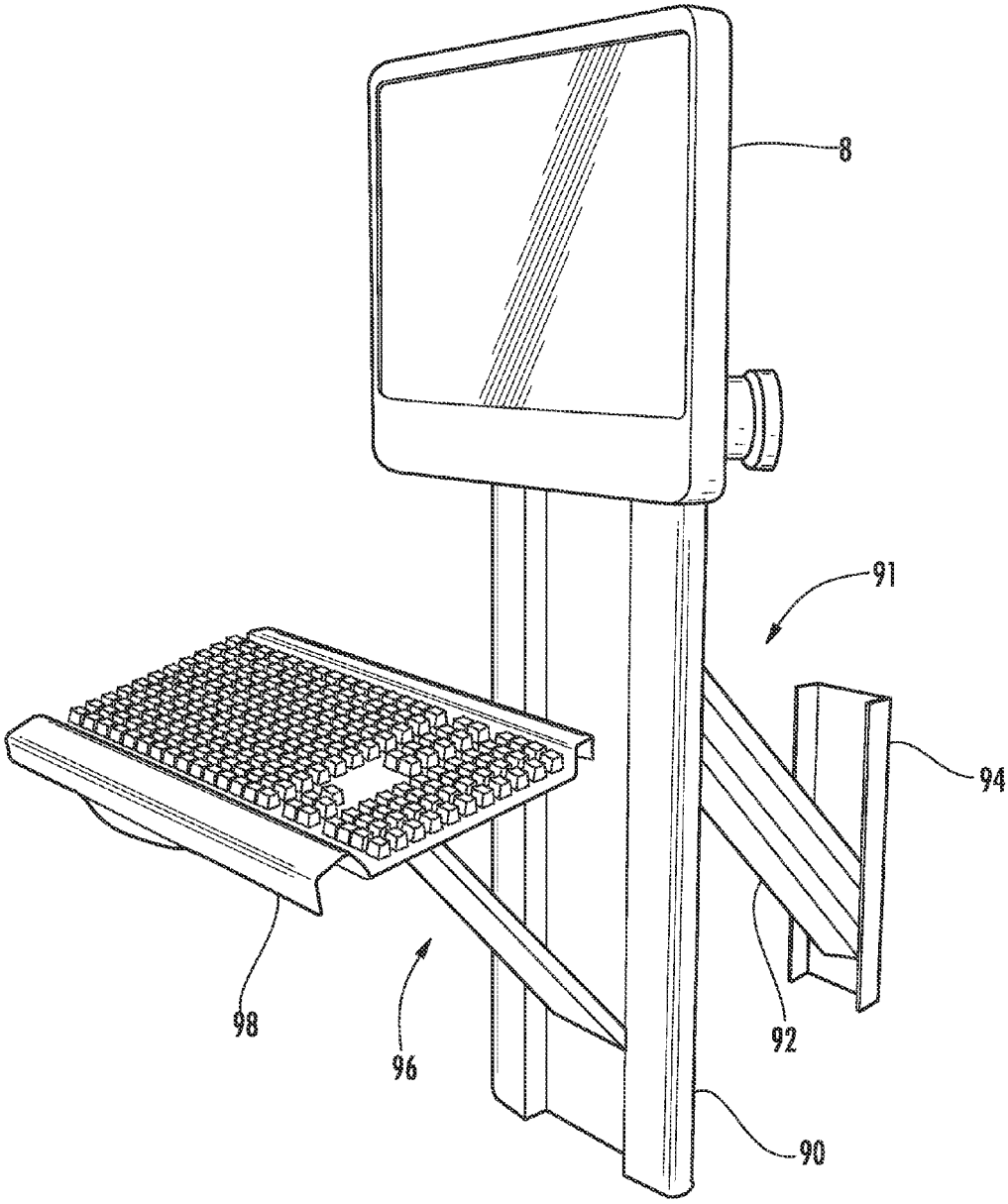
FIG. 12 is a perspective view showing an alternate embodiment of a work station mounting system.

Referring to FIG. 12, an alternate embodiment of the wall support is shown having a vertical track 90 that may be mounted to a vertical surface such as a wall. Vertical track 90 may be mounted to a wall using an adjustable arm 91 connected to a wall mounting bracket 94. A four bar linkage 92 can be extended and retracted to move the support 90 toward and away from the wall mounting bracket 94.

Figure 13:
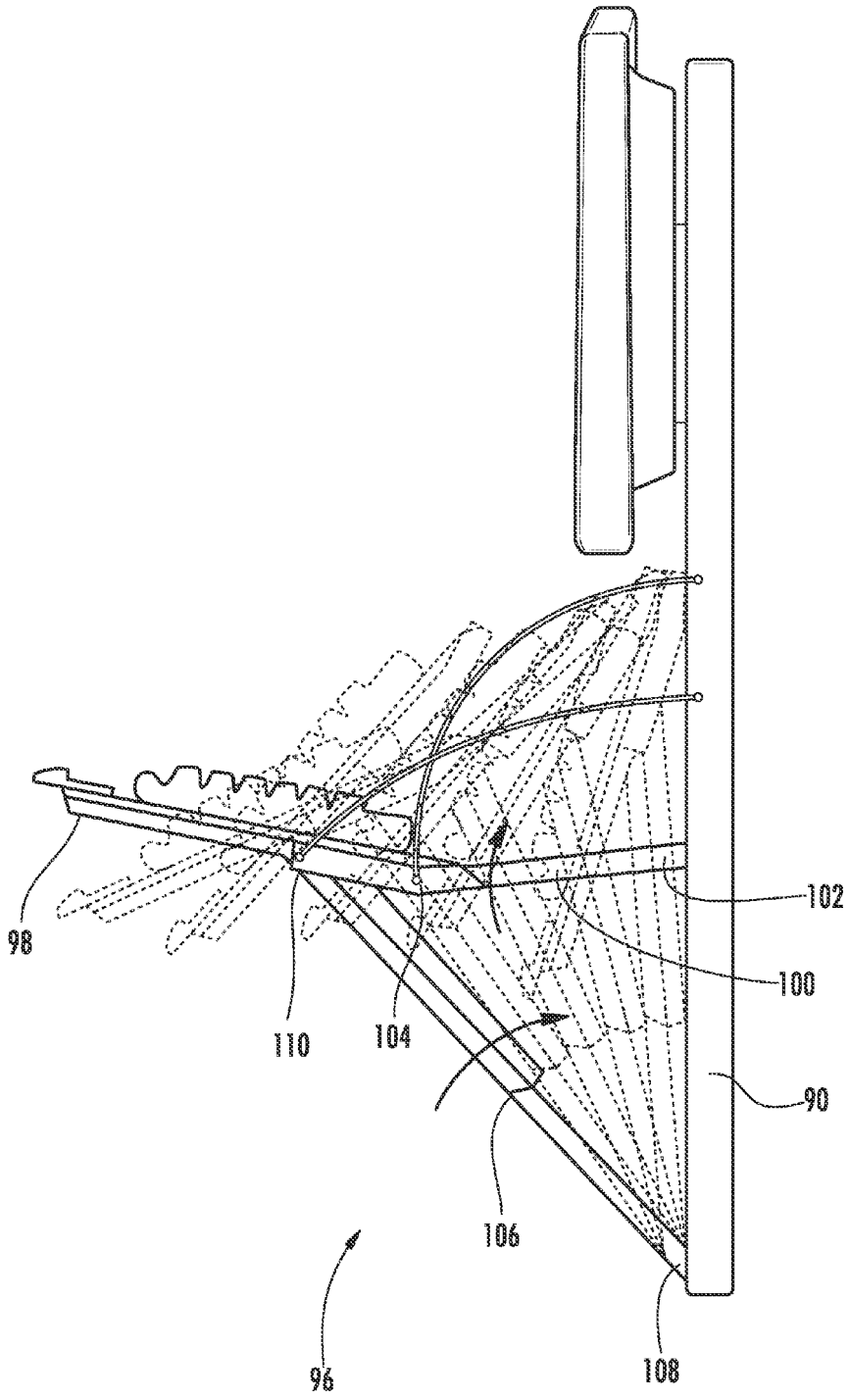
FIG. 13 is a side view showing another alternate embodiment of a work station mounting system.

A double hinge tray support 96 allows the keyboard tray 98 to move from a storage position to an operational position. Referring to FIG. 13 double hinge tray support 96 comprises a first link 100 pivotably connected at one end 102 to support 90 and at the opposite end 104 to the end of keyboard tray 98. A second link 106 is pivotably connected at one end 108 to support 90 and at the opposite end 110 to a midpoint of keyboard tray 98. Both links 100 and 106 are pivoted toward the support 90 to rotate the tray 98 to a vertical storage position.

Figure 16:
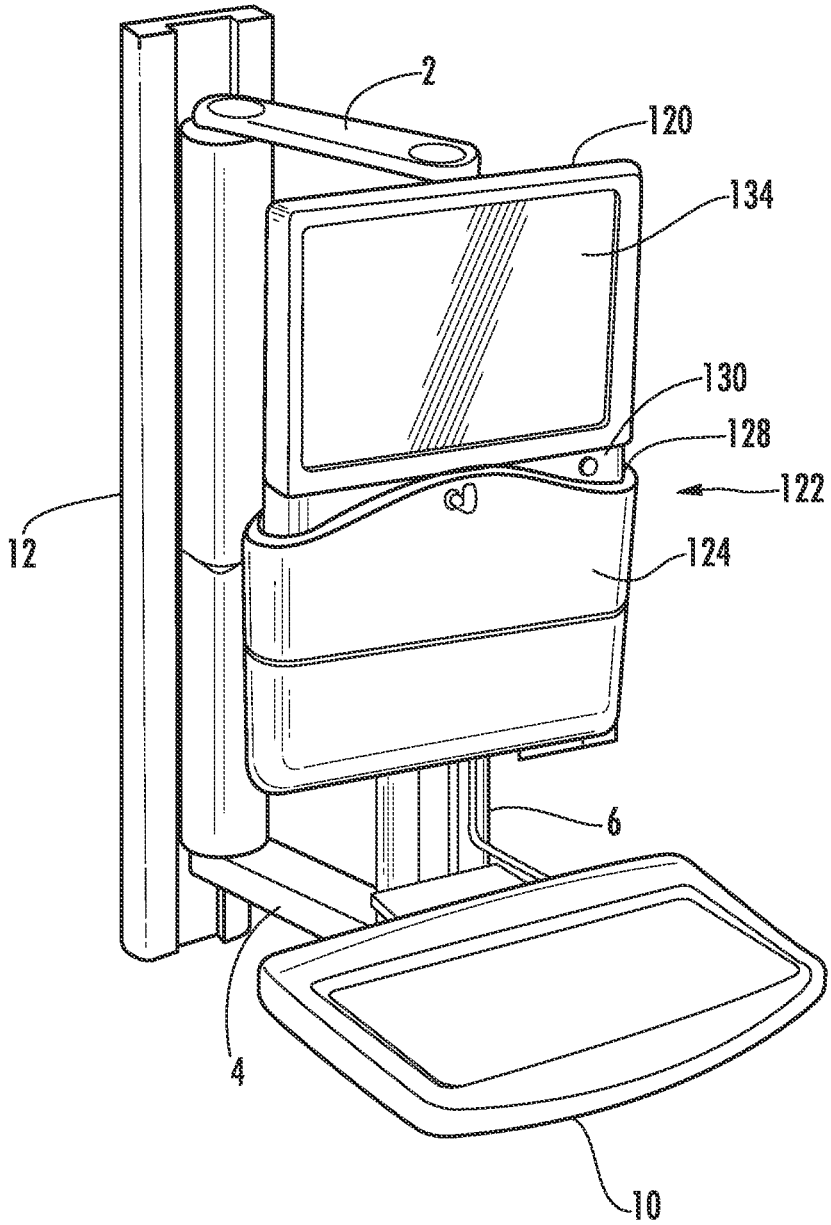
FIGS. 16 and 17 are perspective views showing an embodiment of a wall work station for use with a lap top computer.
Figure 17:
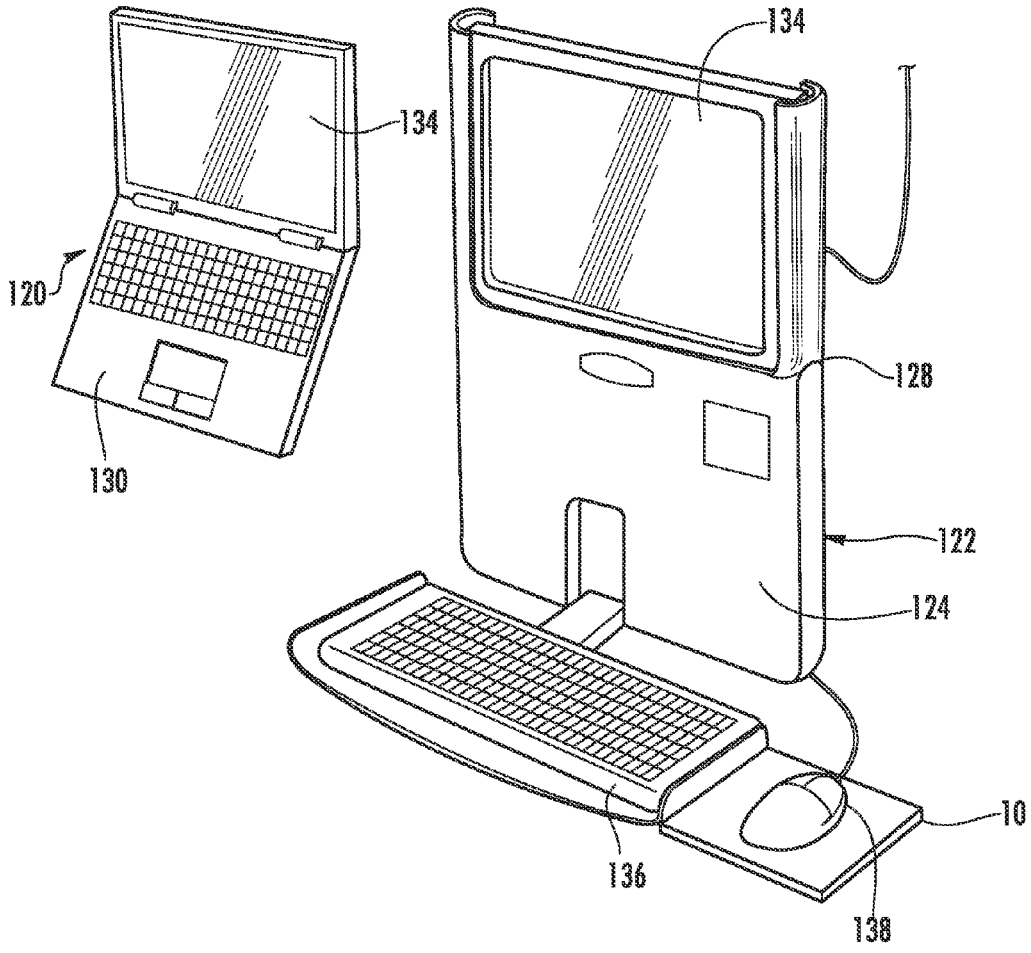

Referring to FIGS. 16 and 17, for applications in which a lap top computer 120 is to be used the monitor support may be replaced by a lap top holder 122. The lap top holder 122 comprises a vertically extending compartment 124 that is supported on track 6. The compartment 124 has an opening 128 at its top end such that a lap top 120, in the fully open position, can have its base 130 with the key board inserted through opening 128 and into the holder 122. The lap top holder 122 is dimensioned such that the lap top monitor 134 extends out of the holder 122 such that it is visible to the user. A separate keyboard 136 and mouse 138 can be attached to the lap top 120 as is known where the key board and mouse are supported on the work station 10.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A work station comprising:

an upper support and a lower support adapted to be mounted to a surface;

an upper arm having a first end and a second end, the upper arm being rigid and non-articulated between the first end and the second end, and a lower arm having a third end and a fourth end, the upper arm being rigid and non-articulated between the third end and the fourth end, the first end of the upper arm being mounted to the upper support for pivoting motion about a first vertical axis and the third end of the lower arm being mounted to the lower support for pivoting motion about the first vertical axis such that the first arm and the second arm have a single degree of motion relative to the first vertical axis where the first arm and the second arm rotate about the first vertical axis simultaneously;

the second end of the upper arm and the fourth end of the lower arm being pivotably mounted to a track such that the track is mounted between the first arm and the second arm such that the track is limited to a single degree of motion relative to the first arm and the second arm where the track pivots relative to the first arm and the second arm about a second vertical axis, said track supporting a vertically displaceable carriage wherein the carriage supports at least one of a monitor and a work platform;

the upper support and the lower support are on a mounting bracket and each of the upper support and the lower support including an upwardly facing protrusion, the protrusions being vertically aligned, the upper arm and the lower arm include downwardly facing apertures that fit over the protrusions such that the downwardly facing apertures rotate relative to the upwardly facing protrusions to form the first vertical axis.

2. The work station of claim 1 wherein the carriage supports a work platform and the work platform supports a key board tray.

3. The work station of claim 1 wherein a lift system supports the carriage for vertical movement.

4. The work station of claim 1 wherein a box is mounted on the rear of the track.

5. The work station of claim 4 wherein the box includes a door that pivots about a horizontal hinge to create a horizontal work surface.

6. The work station of claim 1 wherein the upper arm and lower arm rotate about the first vertical axis through 180 degrees.

7. The work station of claim 1 wherein the track rotates relative to the upper arm and lower arm about the second vertical axis through 180 degrees.

8. The work station of claim 1 wherein wiring passes through at least one of said upper arm and said lower arm.

9. The work station of claim 8 further including a light connected to the wiring.

10. The work station of claim 1 wherein said carriage supports a lap top holder comprising a compartment that retains a lap top computer such that a monitor associated with the lap top computer extends out of the holder.

11. The work station of claim 1 further comprising a tray movably supported below the work platform.

12. A work station comprising:

a mounting bracket adapted to be mounted to a surface;

an upper arm having a first end and a second end, the upper arm being rigid and non-articulated between the first end and the second end, and a lower arm having a third end and a fourth end, the upper arm being rigid and non-articulated between the third end and the fourth end, the first end of the upper arm and the third end of the lower arm being mounted to the mounting bracket for pivoting motion about the a first vertical axis such that the first arm and the second arm have a single degree of motion relative to the mounting bracket where the first arm and the second arm rotate about the first vertical axis simultaneously through approximately 180 degrees such that the upper arm and the lower arm may be disposed adjacent the surface in a first position and a second position;

the upper arm being spaced from the lower arm a distance and the mounting bracket comprising an upper arm support comprising a first upwardly facing protrusion and a lower arm support comprising a second upwardly facing protrusion, the lower arm support being spaced from the upper arm support the distance, the first protrusion and the second protrusion being aligned on the vertical axis, the upper arm comprising a first aperture that fits over the first upwardly facing protrusion and the second arm comprising a second aperture that fits over the second upwardly facing protrusion such that the first and second upwardly facing protrusions define the first vertical axis and are free to rotate in the first and second apertures, respectively, and the first and second upwardly facing protrusions are freely vertically movable relative to the first and second apertures such that the first and second arms are mounted on the mounting bracket by simultaneously vertically dropping the first and second apertures onto the first and second upwardly facing protrusions, respectively;

a track supporting a vertically displaceable carriage, said track supporting at least one of a monitor and a work platform wherein wiring extends from the mounting bracket and passes through at least one of said upper arm and said lower arm and is connected to the at least one of the monitor and the work platform;

the second end of the upper arm and the fourth end of the lower arm being pivotably mounted to the track such that the track is mounted between the first arm and the second arm such that the track is limited to a single degree of motion relative to the first arm and the second arm where the track pivots relative to the first arm and the second arm about a second vertical axis approximately 180 degrees between a third position and a fourth position where the carriage faces away from the surface in both the third position and the fourth position.

13. The work station of claim 12 wherein a lift system supports the carriage for vertical movement.

* * * * *